United States Patent [19]

Goto et al.

[11] 4,415,640

[45] Nov. 15, 1983

[54] ELECTROPHOTOGRAPHIC ELEMENT WITH FLUORENYLIDENE HYDRAZONE COMPOUNDS

[75] Inventors: Satoshi Goto; Kiyoshi Sawada; Osamu Sasaki; Akira Kinoshita, all of Hino; Yoshiaki Takei; Yoshihide Fujimaki, both of Hachioji, all of Japan

[73] Assignee: Konishiroku Photo Industry Co., Ltd., Tokyo, Japan

[21] Appl. No.: 350,039

[22] Filed: Feb. 18, 1982

[30] Foreign Application Priority Data

Feb. 19, 1981 [JP] Japan ..... 56/24078

[51] Int. Cl.[3] ..... G03G 5/06; G03G 5/14

[52] U.S. Cl. ..... 430/59; 430/58; 430/72; 564/250; 564/251

[58] Field of Search ..... 430/58, 59, 72; 564/250, 251

[56] References Cited

U.S. PATENT DOCUMENTS

| | | | |
|---|---|---|---|
| 4,150,987 | 4/1979 | Anderson et al. | 430/59 X |
| 4,278,747 | 7/1981 | Murayama et al. | 430 59 X/ |
| 4,297,426 | 10/1981 | Sakai et al. | 430/59 |
| 4,338,388 | 7/1982 | Sakai et al. | 430/59 |

FOREIGN PATENT DOCUMENTS

| | | | |
|---|---|---|---|
| 1599 | 5/1979 | European Pat. Off. | 430/59 |

*Primary Examiner*—Roland E. Martin, Jr.

*Attorney, Agent, or Firm*—Frishauf, Holtz, Goodman & Woodward

[57] ABSTRACT

Electrophotographic light-sensitive elements containing substituted or unsubstituted fluorenone hydrazones as charge generating or charge transport materials are described.

14 Claims, 6 Drawing Figures

ELECTROPHOTOGRAPHIC ELEMENT WITH FLUORENYLIDENE HYDRAZONE COMPOUNDS

The present invention relates to an electrophotographic light-sensitive element having a conductive support provided thereon with a light-sensitive layer containing a novel photoconductive material.

As electrophotographic light-sensitive elements there have heretofore been widely known those which have a photoconductive layer containing as the principal component thereof such an inorganic photoconductive material as selenium, zinc oxide, cadmium sulfide, and the like. However, these are not necessarily satisfactory ones in such characteristics thereof as the stability to heat, moisture resistance, reproducible life, and the like, and in addition, the toxicity of these materials poses problems in the manufacture and the handling of such light-sensitive elements.

On the other hand, those electrophotographic light-sensitive elements having a light-sensitive layer containing as the principal component thereof an organic photoconductive compound have many such advantages that they are inexpensive, can be easily handled, are generally excellent in the stability to heat compared to selenium light-sensitive elments, and the like, so that in recent years they have drawn much attention. Among such organic photoconductive compounds, poly-N-vinyl carbazole is best known, and those electrophotographic light-sensitive elements having a light-sensitive layer composed principally of a charge-transfer complex formed from said vinyl carbazole and such a Lewis acid as 2,4,7-trinitro-9-fluorenone, and the like have already been made practical reality. While on the other hand, there have been known function-separative electrophotographic light-sensitive elements of the multilayered type or the dispersion type so designed that the carrier-generating function and the carrier-transport function are obtained in different material phases respectively; e.g., such an electrophotographic light-sensitive element having a light-sensitive layer composed of the combination of a carrier-generating layer made of an amorphous selenium thin layer with a carrier-transport layer composed of poly-N-vinyl carbazole has been practically used. However, the poly-N-vinyl carbazole is lacking in flexibility, so that the layer thereof is hard and brittle, tending to cause the layer to crack or to peel off, and therefore the electrophotographic light-sensitive element which uses said material is poor in the durability, while when a plasticizer is added to the carbazole in order to improve this disadvantage, the residual potential when applied to the electrophotographic process is large and become accumulated as the light-sensitive element is repeatedly used, thus causing gradually fog to appear on the reproduced image.

Low molecular weight organic photoconductive compounds, because of generally having no layer formability, may be used together with appropriate binder materials. Accordingly, such compounds are advantageous in respect that an appropriate selection of the kind and the composition ratio of the binder material to be used together with the compound enables to control the physical characteristics or the electrophotographic characteristics of the formed layer to some extent, but the kinds of those organic photoconductive compounds having high compatibility with binder materials are only limited in number, and it is thus the situation that there exist only few organic photoconductive compounds actually applicable to composing photoconductive layers of electrophotographic light-sensitive elements.

For example, the 2,5-bis(p-diethylaminophenyl)-1,3,4-oxadiazole described in U.S. Pat. No. 3,189,447 has the disadvantage that when the compound, because of the small compatibility thereof with the binder material which is normally favorably used as the material for the light-sensitive layer of an electrophotographic light-sensitive element, is used to form a light-sensitive layer by mixing with a binder material such as, e.g., a polyester, polycarbonate and the like in the proportion necessary to obtain desirable electrophotographic characteristics, crystals of the oxadiazole becomes depositing at a temperature of equal to or higher than .50° C., thus causing the eletrophotographic characteristics such as the charge retention, sensitivity, and the like to be deteriorated.

While on the other hand, the diaryl alkane derivative described in U.S. Pat. No. 3,820,989 have the different disadvantage that the compound, although it generally has no problem in the compatibility with binder materials, is poor in the stability to light, so that when the compound is applied to the composing of the light-sensitive layer of a repetitive-transfer-type electrophotographic light-sensitive element which is subjected to repeated charging and exposure operations, the sensitivity of said light-sensitive layer becomes gradually deteriorated.

The p-dimethylaminobenzaldehyde-diphenyl hydrazone described in Japanese Patent Publication Open to Public Inspection (hereinafter referred to as Japanese Patent O.P.I. Publication) No. 59,143/1979 and No. 150,128/1979 has satisfactory compatibility with binder materials, thus being capable of providing relatively excellent initial characteristics-having electrophotographic light-sensitive elements, but the light-sensitive element which uses said compound has the disadvantage that the sensitivity thereof becomes gradually deteriorated and the residual potential becomes accumulated as the light-sensitive element is repeatedly used, and thus the light-sensitive element is inferior in the durability thereof.

It is thus the present situation that any such organic photoconductive compounds as having characteristics desirable for the actual preparation of electrophotographic light-sensitive elements have still not found to date.

It is an object of the present invention to provide an electrophotographic light-sensitive element containing an organic photoconductive compound which is excellent in the compatibility with binder materials, stable against heat and light, and excellent in the carrier-generating capability and particularly in the carrier transportability.

It is another object of the present invention to provide an electrophotographic light-sensitive element which uses a carrier-transportability-having novel material capable of displaying excellent electrophotographic characteristics even in a wide combination range of said material with carrier-generating materials.

It is a further object of the present invention to provide an electrophotographic light-sensitive element having a higher sensitivity and less residual potential.

It is still another object of the present invention to provide an electrophotographic light-sensitive element which, when used as the repetitive-transfer-type electrophotographic light-sensitive element that is subjected to repeated cycles of charging, exposure, development and transfer processes, is less deteriorated by fatigue in the repeated processes, and maintains stable characteristics thereof over an extensive period of time, and thus is excellent in the durability thereof.

As a result of having devoted ourselves to our study to accomplish the above-described objects, we have found that the objects can be attained by using a particular hydrazone compound as the available component in the light-sensitive layer of an electrophotographic light-sensitive element, and thus we have completed the present invention.

The foregoing objects may be attained by the electrophotographic light-sensitive body having a conductive support provided thereon with a light-sensitive layer containing a hydrazone compound having the formula:

Formula (I)

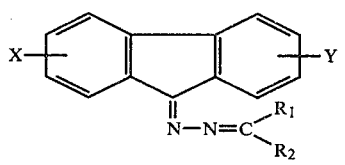

wherein $R_1$ is a substituted or unsubstituted aryl group, preferably substituted or unsubstituted phenyl or naphthyl, the preferred substituent thereof being an alkyl (preferably one having 1 to 8 carbon atoms, and more preferably one having 1 to 4 carbon atoms), an alkoxy (preferably one having 1 to 8 carbon atoms, and more preferably one having 1 to 4 carbon atoms), hydroxy, amino or a substituted amino group, $R_2$ is hydrogen, a substituted or unsubstituted alkyl or aryl group, the preferred alkyl being an alkyl or benzyl having from 1 to 8, and more preferably, 1 to 4 carbon atoms, the preferred aryl being phenyl or naphthyl, the preferred substituent of the aryl being an alkyl (preferably one having 1 to 8, and more preferably, 1 to 4 carbon atoms), an alkoxy (preferably one having 1 to 8, and more preferably 1 to 4 carbon atoms), hydroxy, amino or a substituted amino group, and X and Y each is hydrogen, a halogen, an alkyl (preferably one having 1 to 8, and more preferably, 1 to 4 carbon atoms), an alkoxy (preferably one having 1 to 8, and more preferably 1 to 4 carbon atoms), amino or a substituted amino group.

In the present invention, a light-sensitive element which is excellent in the electrophotographic characteristics, particularly in the durability when repeatedly used, may be provided by the use of a particular hydrazone compound which is excellent in the carrier-generating capability, particularly in the carrier transportability and which have a characteristic not to accumulate residual potential.

And particularly, an electrophotographic light-sensitive element which is excellent in the physical characteristics of the coated layer thereof and in the electrophotographic characteristics such as the charge retention, sensitivity, residual potential, and the like, and which is less deteriorated by fatigue when repeatedly used, thus being excellent in the durability, may be provided by using the hydrazone compound of the present invention, utilizing the excellent carrier transportability thereof, as the carrier-transport material in the light-sensitive layer of the socalled function-separative electrophotographic light-sensitive element wherein the carrier-generating and carrier-transport functions are carried out separately by different materials.

Examples of hydrazone compounds useful for this invention having the foregoing Fourmula (I) include, for example, those having the following formulas:

Exemplified Compounds:

(1)

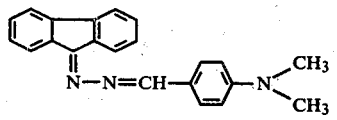

(2)

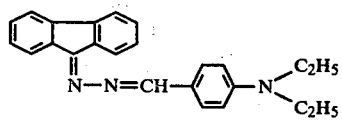

(3)

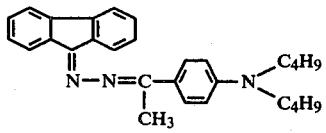

(4)

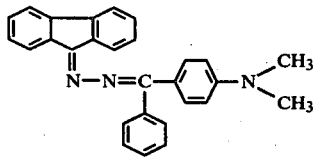

(5)

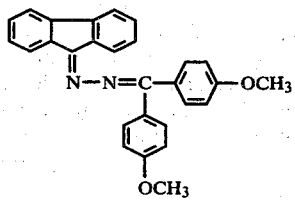

(6)

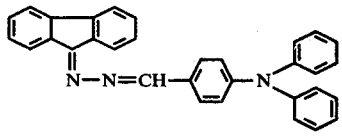

(7)

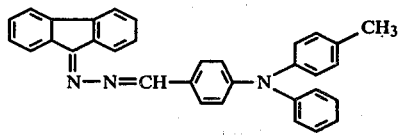

(8)

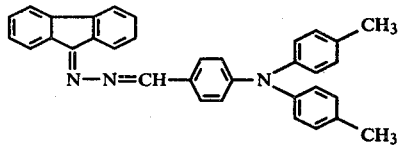

(9)

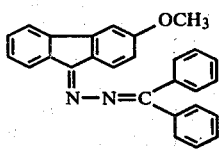

-continued

Exemplified Compounds:

(10)

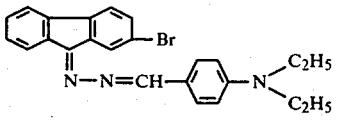

(11)

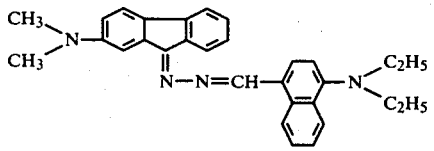

(12)

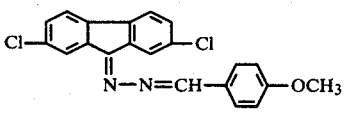

(13)

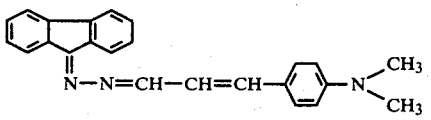

The above-enumerated hydrazone compounds may be readily synthesized is known manners; for example, a hydrazone commpound having Formula (I) may be obtained by the dehydration-condensation reaction of a fluorenone hydrazone having the following Formula (II) with a carbonyl compound having the following Formula (III) in a solvent such as an alcohol, and, if necessary, in the presence of an acid catalyst:

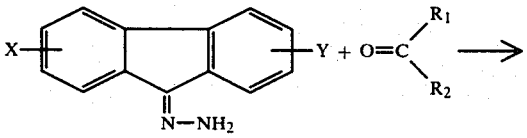

[II] [III]

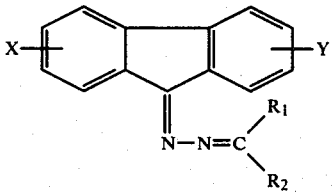

[I]

The $R_1$, $R_2$, X and Y in the above Formulas (I), (II) and (III) are the same as those substituents defined in Formula (I).

The following is a typical method for the synthesis of a hydrazone compound used in the present invention.

SYNTHESIS EXAMPLE

Synthesis of Exemplified Compound (1)

19.4 g (0.1 mole) of fluorenone hydrazone and 14.9 g (0.1 mole) of N,N-dimethylaminobenzaldehyde were dissolved into 300 ml of ethanol, and to the solution were added 2 ml of acetic acid. The resulting solution was refluxed with heating for 30 minutes. The deposited crystals were filtered and recrystallized from ethanol, thereby obtaining orange needle crystals. Yield: 28.9 g, 88.9%. M.P.: 161° to 162° C.

In the present invention, the hydrazone compound of the present invention may be contained as a photoconductive compound in the light-sensitive layer, or the hydrazone compound, utilizing the carrier transportability thereof, is used as a carrier-transport material to be mixed with a carrier-generating material to make a two-phase-composition light-sensitive layer, or the hydrazone compound-containing carrier-transport layer may be superposed on the carrier-generating material-containing layer to make a two-layer-composition light-sensitive layer.

In the above-described light-sensitive layers, the foregoing hydrazone compounds, because of having no layer formability, in order to form a layer, are desired to be used together with various binder materials which serve to fix such compounds.

The foregoing hydrazone compounds may be used singly or in a mixture of two or more kinds thereof, particularly in the case of the two-phase or two-layer-composition light-sensitive layer of the function separative type, different carrier-transport materials may be used together.

As the above-mentioned binder materials, arbitrary ones may be used, but those hydrophobic, highly dielectric and insulative film-formable macromolecular polymers are desired to be used. Such macromolecular polymers include, for example, the following compounds, but are not limited thereto:

(1) polycarbonates,
(2) polyesters,
(3) methacrylate resins,
(4) acrylic resins,
(5) polyvinyl chloride,
(6) polyvinylidene chloride,
(7) polystyrenes,
(8) polyvinyl acetate,
(9) styrene-butadiene copolymers,
(10) vinylidene chloride-acrylonitrile copolymers,
(11) vinyl chloride-vinyl acetate copolymers,
(12) vinyl chloride-vinyl acetate-maleic anhydride copolymers,
(13) silicone resins,
(14) silicone-alkyd resins,
(15) phenol-formaldehyde resins,
(16) styrene-alkyd resins, and
(17) poly-N-vinyl carbazole.

These binder materials may be used singly or in a mixture of two or more kinds thereof.

In the foregoing function-separative light-sensitive element, those carrier-generating materials usable in combination with the foregoing hydrazone compounds as the carrier-transport material include, for example, the following materials:

(1) selenium and selenium alloys,
(2) inorganic photoconductive materials such as CdS, CdSe, CdSSe, HgS, and the like,
(3) Perylene dyes such as perylenic acid anhydride, perylenic acid diimide, and the like,
(4) indigoid dyes,
(5) polycyclic quinones such as anthraquinones, pyrenequinones, flavanthrones, anthanthrones, and the like,
(6) bis-benzimidazole dyes,
(7) quinacrydone dyes,
(8) azo dyes such as monoazo dye, bisazo dye, trisazo dye, and the like, (9) indanthrone dyes,
(10) squarylium dyes,
(11) phthalocyanine dyes such as nonmetallic phthalocyanine, metallic phthalocyanine, and the like,
(12) charge-transfer complexes formed from electron-providing materials such as poly-N-vinyl carbazole and electron-receptive materials such as trinitrofluorenone, and
(13) eutectic complexes formed from pyrylium salts or thiapyrylium salts and polycarbonates.

These carrier-generating materials may be used not only in single but in combination of two or more kinds thereof, and in order to render the material in the form of a layer in the case where it has no layer formability by itself, the material should be used together with an appropriate binder material selected from among ones similar to those used for fixing the foregoing hydrazone compounds to form a layer.

The light-sensitive element of the present invention may contain in the light-sensitive layer thereof a plasticizer, residual potential reducer, fatigue reducer, and the like.

The mechanical construction of the electrophotographic light-sensitive element of the present invention is illustrated in the drawings wherein, as shown in FIG. 1 and FIG. 2, a conductive support 1 is provided thereon with a multilayered light-sensitive layer 4 composed of a carrier-generating layer 2 containing as the principal component thereof a carrier-generating material and a carrier-transport layer 3 containing as the principal component of the carrier-transport material thereof the foregoing hydrazone compound, or alternatively, as shown in FIG. 3 and FIG. 4, light-sensitive layer 4 may be provided through an interlayer 5 on conductive support 1. When light-sensitive layer 4 is thus composed of two layers the most excellent electrophotographic characteristics-having electrophotographic light-sensitive element can be obtained. And in this invention, as shown in FIG. 5 and FIG. 6, the conductive support may also be provided directly thereon or through interlayer 5 thereon with a light-sensitive layer 4 prepared by dispersing a powdery carrier-generating material 7 into a layer 6 containing as the principal component thereof the foregoing carrier-transport material.

In the case where light-sensitive layer 4 is of the two-layer composition, which of carrier-generating layer 2 and carrier-transport layer 3 should be the upper layer is determined according to the charging polarity used-whether the positive or the negative; that is, where the light-sensitive body is of the negatively charging type, it is advantageous that carrier-transport layer 3 is disposed to be the upper layer because the hydrazone compound in carrier-transport layer 3 is a material having a high transportability to the positive hole.

The carrier-generating layer 2, one of the two layers of the two-layer composition light-sensitive layer 4, may be formed directly on conductive support 1 or on carrier-transport layer 3, or, if necessary, on an interlayer such as an adherent layer, barrier layer, or the like provided on the support in one of the following manners:

(1) vacuum deposition, (2) the manner that a carrier-generating material is dissolved into an appropriate solvent and the solution is coated, and (3) the manner that a carrier-generating material is finely dispersed by means of a ball mill or homomixer into a dispersion medium, into which is, if necessary, further mixed a binder material to be dispersed, and the resulting dispersed liquid is coated.

The thickness of the thus formed carrier-generating layer 2 should be preferably from 0.01 to 5 microns, and more preferably from 0.05 to 3 microns, while the thickness of carrier-transport layer 3, although changeable at need, should be preferably normally from 5 to 30 microns. The composition proportion in carrier-transport layer 3 should be preferably the binder material in the quantity of 0.8 to 4 parts by weight per part by weight of the carrier-transport material, but in the case of forming the light-sensitive layer 4 into which a powdery carrier-generating material is dispersed, the proportion is desired to be in the range of the binder material in the quantity of not more than 5 parts by weight per part by weight of the carrier-generating material. Further, in the case where carrier-generating layer 2 is composed as of the dispersion type with a binder material, the binder material should be used likewise in the quantity of not more than 5 parts by weight per part by weight of the carrier-generating material.

In addition, for conductive support 1 of the electrophotographic light-sensitive element of the present invention there may be used such materials as a metallic plate, conductive compounds such as, e.g., conductive polymers, indium oxide, and the like, conductivity-provided paper or plastic film coated, vacuum-deposited or laminated with a metallic thin layer such as of aluminum, palladium, gold, and the like. Materials usable for interlayer 5 such as an adherent layer, barrier layer, and the like include, in addition to those macromolecular polymers used as the foregoing binder materials, organic macromolecular materials such as gelatin, casein, starch, polyvinyl alcohols, vinyl acetate, ethyl cellulose, carboxymethyl cellulose, and the like, or aluminum oxide.

The electrophotographic light-sensitive element of the present invention, composed as has been illustrated above, is excellent in the charging, sensitivity and image-forming characteristics as will be obvious from examples which will be illustrated hereinafter, and particularly is less deteriorated by fatigue even when applied to the repetitive transfer type electrophotographic process, so that the light-sensitive element is excellent in the durability as well.

The present invention is illustrated in detail with reference to examples below, but the embodiments of the present invention are not limited thereto.

EXAMPLE 1

An aluminum foil-laminated conductive polyester film support was provided thereon with a 0.05-micron-thick interlayer composed of a vinyl chloride-vinyl acetate-maleic anhydride copolymer "S-lec MF-10" (manufactured by Sekisui Chemical Co., Ltd.), and this was vacuum-deposited thereon with a 0.5-micron-thick dibromoanthanthrone (Monolite Red 2Y" (C.I.No. 59300, manufactured by ICI) to form a carrier-generating layer.

On this was then formed a carrier-transport layer by coating a solution prepared by dissolving 6 parts by weight of Exemplified Compound (2) and 10 parts by weight of a polyester resin "Vylon 200" (manufactured by Toyo Spinning Co., Ltd.) into 90 parts by weight of 1,2-dichloroethane so that the thickness thereof after drying becomes 10 microns, thereby forming an electrophotographic light-sensitive element of the present invention.

The electrophotographic light-sensitive element was measured for the electrophotographic characteristics thereof by the dynamic process using an electrostatic copying paper tester Model SP-428 (manufactured by Kawaguchi Electronic Works Co., Ltd.).

The surface potential $V_A$ when the surface of the photoconductive layer of the foregoing light-sensitive body was charged for 5 seconds applying the charging voltage of −6.0 kv, the exposure $E_{\frac{1}{2}}$ (lux.sec)(half-reducing exposure) required to reduce by half the surface potential $V_A$ by adjusting the tungsten light so that the illumination on the surface of the light-sensitive body is 35 lux, and the surface potential (residual potential) $V_R$ after exposing the light-sensitive body with the exposure of 30 lux.sec. were found respectively.

The same measurements were repeated 100 times. The results are shown in Table 1.

TABLE 1

| | 1st | 100th |
|---|---|---|
| $V_A$ (V) | 1190 | 1240 |
| $E_{\frac{1}{2}}$ (lux.sec) | 7.6 | 7.8 |
| $V_R$ (V) | 12 | 14 |

EXAMPLE 2

Another electrophotographic light-sensitive element of the present invention was prepared in the same manner as that in Example 1 with the exception that as the carrier-generating layer, N,N'-dimethyl perylene-3,4,-9,10-tetracarboxylic acid diimide "Paliogen Maroon 3920" (C.I.No. 71130, manufactured by BASF) was vacuum-deposited in the thickness of 0.5 micron.

The prepared electrophotographic light-sensitive body was measured in the same manner as in Example 1, then the results as shown in Table 2 were obtained.

TABLE 2

| | 1st | 100th |
|---|---|---|
| $V_A$ (V) | −1020 | −1140 |
| $E_{\frac{1}{2}}$ (lux.sec) | 9.5 | 9.8 |
| $V_R$ (V) | −10 | −12 |

EXAMPLE 3

An aluminum-deposited polyester film support was provided thereon with a same interlayer as that used in Example 1, and on this was coated a solution so that the coated amount thereof after drying is 0.2 g/m$^2$, said solution being prepared by dissolving 1 part by weight of chlorodian blue into 140 parts by weight of a mixture solution of ethylendiamine, n-butylamine and tetrahydrofuran mixed in the proportion of 1.2:1.0:2.2, said chlorodian blue having the formula:

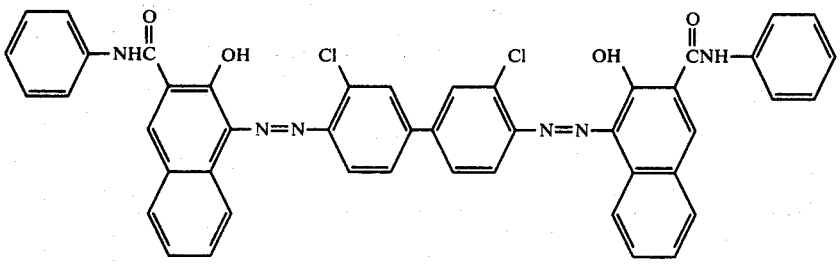

On the thus formed carrier-generating layer was formed a carrier-transport layer by coating a solution so that the thickness thereof after drying becomes 12 microns, said solution being prepared by dissolving 6 parts by weight of Exemplified Compound (4) and 10 parts by weight of a polycarbonate "Panlite L-1250" (manufactured by Teijin, Ltd.) into 90 parts by weight of 1,2-dichloroethane.

The thus obtained electrophotographic light-sensitive element was measured for the half-reducing exposure thereof, then the $E_{\frac{1}{2}}$ was 3.4 lux.sec. Further, the electrophotographic light-sensitive element was applied to an electrophotographic copier U-Bix 2000R (manufactured by Koniskiroku Photo Industry Co., Ltd.) to make imagewise copies, then true-to-the-original, contrasty, clear and sharp imagewise copies were obtained. This image quality was little changed even after repeating the copying operation 10,000 times, giving similar quality image to the initial one.

EXAMPLES 4 TO 8

Electrophotographic light-sensitive elements of the present invention were prepared in the same manner as in Example 3 with the exception that in the formation of the respective carrier-transport layers, Exemplified compounds (3), (5), (6), (8) and (9) were used respectively in place of the Exemplified Compound (4) in Example 3. The thus prepared electrophotographic light-sensitive elements each was subjected to the measurement for the half-reducing exposure $E_{\frac{1}{2}}$ in the same manner as in Example 1. The results are as shown in Table 3.

TABLE 3

| | Hydrazone compound | $E_{\frac{1}{2}}$ (lux.sec) |
|---|---|---|
| Example 4 | Exemplified Compound (3) | 3.7 |
| Example 5 | Exemplified Compound (5) | 4.1 |
| Example 6 | Exemplified Compound (6) | 3.4 |
| Example 7 | Exemplified Compound (8) | 3.2 |
| Example 8 | Exemplified Compound (9) | 3.6 |

EXAMPLE 9

An aluminum-deposited conductive polyester film support was vacuum-deposited thereon with a selenium-tellurium alloy (containing 20% tellurium) to thereby form a 0.5-micron-thick carrier-generating layer. On this was formed a carrier-transport layer by coating a solution so that the thickness thereof after drying becomes 10 microns, said solution being prepared by dissolving 6 parts by weight of Exemplified Compound (7) and 10 parts by weight of a methacrylic resin "Acrypet" (manufactured by Mitsubishi Rayon Co., Ltd.) into 90 parts by weight of 1,2-dichloroethane.

The half-reducing exposure $E_{\frac{1}{2}}$ of the thus obtained electrophotographic light-sensitive element of the present invention was 2.4 lux.sec.

EXAMPLE 10

A coating solution prepared by mixing and sufficiently dissolving 1.5 parts by weight of a polycarbonate "Jupilon S-1000" (manufactured by Mitsubishi Gas Chemicals Co., Inc.) into a dispersion liquid prepared by dispersing by means of a ball mill 1 part by weight of dibromoanthanthrone "Monolite Red 2Y" (C.I.No. 59300, manufactured by ICI) into 30 parts by weight of 1,2-dichloroethane was coated to form a carrier-generating layer on a same conductive support as was used in Example 1 so that the thickness thereof after drying becomes 2 microns. And on this was formed a carrier-transport layer by coating a solution so that the thickness thereof after drying becomes 10 microns, said solution being prepared by dissolving 7 parts by weight of Exemplified Compound (1) and 10 parts by weight of the polycarbonate "Jupilon S-1000" (manufactured by Mitsubishi Gas Chemicals Co., Inc.) into 90 parts by weight of 1,2-dichloroethane, thereby producing an electrophotographic light-sensitive element of the present invention.

The half-reducing exposure $E_{\frac{1}{2}}$ of the resulting electrophotographic light-sensitive element was 9.2 lux.sec.

BRIEF DESCRIPTION OF THE DRAWINGS

FIG. 1 to FIG. 6 are sectional views showing exemplified mechanical compositions of the electrophotographic light-sensitive element of the present invention wherein

Figure 1:
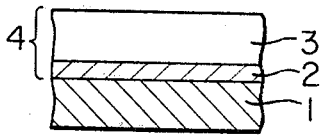
Figure 2:
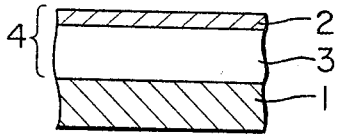
Figure 3:
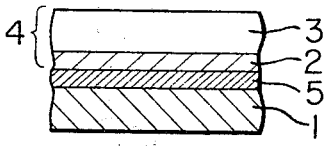
Figure 4:
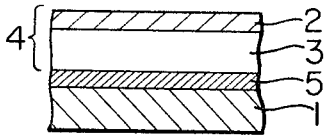
Figure 5:
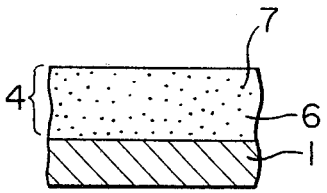
Figure 6:
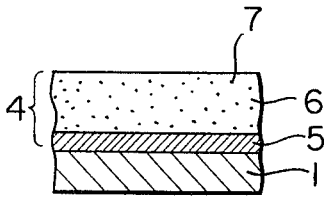

| | | | |
|---|---|---|---|
| 1 | conductive support, | 5 | interlayer |
| 2 | carrier-generating layer | 6 | carrier-transport material-containing layer, and |
| 3 | carrier-transport layer | 7 | carrier-generating layer. |
| 4 | light-sensitive layer | | |

We claim:

1. An electrophotographic light-sensitive element comprising a conductive support having thereon a light-sensitive layer comprising at least one hydrazone compound having the following formula:

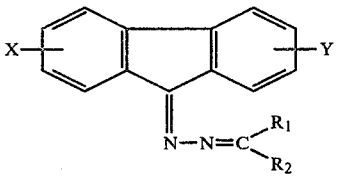

wherein $R_1$ is selected from the group consisting of an aryl group and a substituted aryl group; $R_2$ is selected from the group consisting of a hydrogen atom, an alkyl group, a substituted alkyl group, an aryl group and a substituted aryl group; and X and Y are each selected from the group consisting of a hydrogen atom, a halogen atom, an alkyl group, a substituted alkyl group, an alkoxy group, a substituted alkoxy group, an amino group, a substituted amino group, a nitro group and a cyano group.

2. An electrophotographic light-sensitive element according to claim 1, wherein said alkyl group has 1 to 8 carbon atoms.

3. An electro photographic light-sensitive element according to claim 2, wherein said alkyl group has 1 to 4 carbon atoms.

4. An electrophotographic light-sensitive element according to claim 1, wherein said alkoxy group has 1 to 8 carbon atoms 5. An electrophotographic light-sensitive element according to claim 4, wherein said alkoxy group has 1 to 4 carbon atoms.

6. An electrophotographic light-sensitive element according to claim 1, wherein said substituted alkyl group is a benzyl group.

7. An electrophotographic light-sensitive element according to claim 1, wherein said aryl group is selected from the group consisting of a phenyl group and a naphthyl group.

8. An electrophotographic light-sensitive element according to claim 1, wherein said light-sensitive layer further comprises at least one carrier generating material.

9. An electrophotographic light-sensitive element according to claim 8, wherein said light-sensitive layer comprises two layers, a first layer containing said carrier generating material and a second layer containing said hydrazone compound.

10. An electrophotographic light-sensitive element according to claim 1, wherein said light-sensitive layer further comprises a binder material.

11. An electrophotographic light-sensitive element according to claim 1, wherein $R_1$ is selected from the group consisting of a phenyl group and a naphthyl group; $R_2$ is selected from the group consisting of a hydrogen atom, a benzyl group, a phenyl group and a naphthyl group; and X and Y are each selected from the group consisting of a hydrogen atom, a halogen atom, a benzyl group, an alkoxy group having 1 to 4 carbon atoms, an amino group, a nitro group and a cyano group.

12. An electrophotographic light-sensitive element according to claim 11, wherein said light-sensitive layer further comprises at least one carrier generating material.

13. An electrophotographic light-sensitive element according to claim 12, wherein said light-sensitive layer comprises two layers, a first layer containing said carrier generating material and a second layer containing said hydrazone compound.

14. An electrophotographic light-sensitive element according to claim 11, wherein said light-sensitive layer further comprises a binder material.

* * * * *